United States Patent [19]

Iijima et al.

[11] Patent Number: 4,547,458

[45] Date of Patent: Oct. 15, 1985

[54] SILVER HALIDE COLOR PHOTOGRAPHIC LIGHT-SENSITIVE MATERIAL

[75] Inventors: Toshifumi Iijima; Kiyoshi Yamashita, both of Hino, Japan

[73] Assignee: Konishiroku Photo Industry Co., Ltd., Tokyo, Japan

[21] Appl. No.: 699,057

[22] Filed: Feb. 7, 1985

Related U.S. Application Data

[63] Continuation of Ser. No. 511,797, Jul. 7, 1983, abandoned.

[30] Foreign Application Priority Data

Jul. 10, 1982 [JP] Japan ..... 57-120240

[51] Int. Cl.[4] ..... G03C 1/46

[52] U.S. Cl. ..... 430/505; 430/506; 430/509; 430/544; 430/567; 430/569

[58] Field of Search ..... 430/505, 506, 509, 544, 430/567, 569

[56] References Cited

U.S. PATENT DOCUMENTS

| | | | |
|---|---|---|---|
| 3,726,681 | 4/1973 | Dankow et al. | 430/509 |
| 4,145,219 | 3/1979 | Kato et al. | 430/502 |
| 4,170,479 | 10/1979 | Usami | 430/509 |
| 4,267,264 | 5/1981 | Lohmann et al. | 430/506 |
| 4,370,410 | 1/1983 | Iijima et al. | 430/506 |
| 4,388,401 | 6/1983 | Hasebe et al. | 430/509 |
| 4,414,308 | 11/1983 | Hamada | 430/509 |

*Primary Examiner*—J. Travis Brown

*Attorney, Agent, or Firm*—Jordan B. Bierman

[57] ABSTRACT

A silver halide color photographic light-sensitive material comprising a support having at least one silver halide emulsion layer thereon, said silver halide emulsion layer having a sensitivity to a certain spectral region and at least one of said silver halide emulsion layers comprising a plurality of different-speed light-sensitive layers wherein the difference in speed between the fastest-speed layer and the second fastest-speed layer of said plurality of light-sensitive layers, in terms of log I·t, is 0.2 to 0.7, and each of at least said fastest-speed and said second fastest-speed layers contains at least one monodispersed silver halide emulsion, said monodispersed emulsion being light-sensitive and consisting essentially of silver halide particles having a granularity distribution represented by the formula $$S/\bar{r} \leqq 0.15$$

wherein S is the standard deviation of particle size and $\bar{r}$ is the average particle size given by $$S = \sqrt{\Sigma (\bar{r} - ri)^2 ni / \Sigma ni} \text{ and } \bar{r} = \frac{\Sigma rini}{\Sigma ni}$$

wherein ri and ni are the particle size of the ith particle and number of particles having a size ri respectively.

26 Claims, No Drawings

SILVER HALIDE COLOR PHOTOGRAPHIC LIGHT-SENSITIVE MATERIAL

This application is a continuation of application Ser. No. 511,797, filed July 7, 1983, now abandoned, which claims priority of Japanese application No. 120240/1982, filed July 10, 1982.

DETAILED DESCRIPTION OF THE INVENTION

1. Field of the Invention

The present invention relates to a silver halide color photographic light-sensitive material, and more particularly to a silver halide color photographic light-sensitive material which has a very high photographic speed and whose dye image to be formed is of excellent graininess.

2. Description of the Prior Art

Generally speaking, silver halide color photographic materials comprise a support such as, for example, of cellulose triacetate, polyethylene terephthalate, or the like, uniformly coated thereon with a blue-sensitive silver halide emulsion layer, a green-sensitive silver halide emulsion layer, a red-sensitive silver halide emulsion layer, nonlight-sensitive filter layers, and the like.

In the above-mentioned color photographic light-sensitive material, as a conventionally known method for sensitization of or for improving the graininess of the light-sensitive material, for example, British Pat. No. 818,687 discloses a method wherein, in a light-sensitive layer comprised of two equally color-sensitive layers each containing a same-color-in-the-same-density-forming coupler, a lower-speed silver halide emulsion layer is provided as the lower layer and a higher-speed silver halide emulsion layer is provided as the upper layer.

However, the above-mentioned light-sensitive material is disadvantageous in respect that as the photographic speed is increased the graininess becomes deteriorated, resulting in diminishing the enlargeability of a light-sensitive material such as photographic film.

As a method for removing the above-mentioned drawback to improve the graininess of a color image, West German Pat. No. 1,121,470 discloses a method which arranges the color density of the emulsion layer whose photographic speed and particle size are larger so as to be smaller than that of the lower-speed emulsion layer.

Japanese Patent Examined Publication No. 21248/1975 discloses a light-sensitive material comprising different-speed-having silver halide emulsion layers each containing a 4-equivalent coupler, of which emulsion layers the higher-speed silver halide emulsion layer is from 0.1 to 0.6 higher in the speed than the lower-speed silver halide emulsion layer, and contains a coupler capable of coupling twice to 20 times as fast as that contained in the lower-speed silver halide emulsion layer.

These methods, however, have many disadvantages: The method disclosed in West German Pat. No. 1,121,470 has the disadvantage that the photographic speed of the silver halide emulsion is not sufficiently utilized, while in the case of the light-sensitive material in Japanese Patent Examined Publication No. 21248/1975, the speed of the medium- or higher-speed silver halide emulsion is not utilized sufficiently, and to the lower-speed emulsion layer a relatively large particle-size having emulsion is applied, and consequently no thorough improvement on the graininess is accomplished.

AN OBJECT OF THE INVENTION

It is an object of the present invention to provide a color photographic light-sensitive material which has a very high photographic speed and whose dye image to be formed is of excellent graininess.

CONSTITUENTS OF THE INVENTION

As a result of our continued study to improve the image graininess, we have found a method which adjusts the difference between the photographic speeds of different-speed-having light-sensitive emulsion layers and uses a monodispersed silver halide emulsion to thereby enable to improve the graininess as well as to utilize sufficiently the speed of silver halide particles and to obtain a color photographic light-sensitive material having such a high speed as unexpectable from those methods in the prior art, thus having completed the present invention.

Namely, the silver halide color photographic light-sensitive material of the present invention is such that in a silver halide color photographic light-sensitive material which comprises a support having thereon at least one silver halide emulsion layer having a sensitivity to a certain spectral region, at least one of which silver halide emulsion layers is composed of a plurality of different photographic speed-having light-sensitive emulsion layers, of the plurality of light-sensitive emulsion layers the difference in the photographic speed between the highest speed-having layer and the second highest photographic speed-having layer is from 0.2 to 0.7 in terms of log I·t, and at least the highest speed and the second highest speed-having layers each contains at least one monodispersed silver halide emulsion.

The present invention will be further illustrated in detail below:

The silver halide color photogrphic light-sensitive material of the present invention comprises a support having thereon at least one silver halide emulsion layer having a sensitivity to a certain spectral region, and at least one of the silver halide emulsion layers is composed of a plurality of different photographic speed-having light-sensitive layers, the light-sensitive layers satisfying the following conditions:

First, in the plurality of light-sensitive layers, the difference in the photographic speed between the highest speed-having layer and the second highest speed-having layer is required to be within the range of from 0.2 to 0.7 in terms of log I·t. With the difference in the speed set within this range, the succession of the gradations of the highest speed-having layer and the second highest speed-having layer becomes in a satisfactory condition and the effective utilization of the silver halide particles can be accomplished, thus resulting in the effectuation of the present invention.

If the difference in the speed is less than 0.2 in terms of log I·t, it becomes meaningless to provide not less than two different speed-having light-sensitive layers, and besides, the silver halide emulsion contained in the coated light-sensitive layers does not contribute to the improvement on the graininess. On the other hand, if the difference exceeds 0.7, the combined gradation formed by the highest speed-having layer and the second highest speed-having layer becomes inconsistent, thereby bringing about conspicuous discordance of tone in the medium density area of the resulting dye image.

The above difference in the speed is preferably within the range of from 0.2 to 0.6, and more preferably from 0.2 to 0.5 in terms of log I·t.

Secondly, in the silver halide color photographic light-sensitive material of the present invention, of the foregoing plurality of light-sensitive layers, at least the highest speed-having layer and the second highest speed-having layer each has at least one monodispersed silver halide emulsion.

The amount of the monodispersed silver halide emulsion contained in these layers is preferably not less than 30% by weight, and more preferably not less than 50% by weight, of the total amount of the overall silver halide emulsions.

The "monodispersed emulsion" herein means what has the value being not more than 0.15 which is obtained when dividing the standard deviation S as defined in the following formula by the mean particle size $\bar{r}$. Further, the value is more desirable to be not more than 0.10 for better effective improvement of the image sharpness.

$$S = \sqrt{\frac{\Sigma(\bar{r} - ri)^2 ni}{\Sigma ni}} \quad \frac{S}{\bar{r}} \leqq 0.15$$

The "mean particle size $\bar{r}$" herein, if the silver halide is of spherical particles, means the mean diameter of the particles or, if it is of non-spherical particles, means the mean value of the diameters of the converted same areal circular images from the projected images thereof and, when the individual radii each is ri and when the quantity of the radii is ni, is as defined by the following formula:

$$\bar{r} = \Sigma niri / \Sigma ni$$

In this invention, preferred $\bar{r}$ is within the range of from 0.3μ to 1.5μ.

In this invention, the silver halide particles contained in each of the foregoing plurality of different photographic speed-having light-sensitive layers are desirable to satisfy the relation represented by the following formula:

$$0.20 < 2 \log (x_2/x_1) < 0.60$$

wherein $x_1$ represents the largest particle size among the particle sizes which give maximum values of the particle size distribution of the silver halide particles contained in the highest photographic speed-having layer, and $x_2$ represents the largest particle size among the particles sizes which give maximum values of the particle size distribution of the silver halide particles contained in the second highest photographic speed-having layer. And of the plurality of light-sensitive layers, in each of the highest-speed-having and the second highest-speed-having layers, the group of the silver halide particles having the largest particle size among the particle sizes which give maximum values of the particle size distribution is desirable to be composed substantially of monodispersed silver halide particles. Further, in the present invention, the silver halide emulsion in at least one light-sensitive layer of the light-sensitive layers is desirable to be composed substantially of regular crystals.

The color photographic light-sensitive material of the present invention is desirable to be of the following: In a structure comprising equally spectrally sensitive silver halide particles-having silver halide emulsion layers comprising at least two different speed-having silver halide emulsion layers, of the at least two layers the upper layer from the support is desirable to be higher in the speed than the lower layer. And, in the present invention, the mean particle sizes of the silver-halide particles contained in the at least two layers having their sensitivity to the same spectral region are desirable to be different; for example, the preferred mean particle size of the silver halide particles contained in the higher-speed emulsion layer is from 0.4 to 15μ, while the preferred mean particle size of the silver halide particles contained in the lower-speed emulsion layer is from 0.1 to 0.8μ. In general color photographic light-sensitive materials, there are cases where not less than two different mean particle sizes-having silver halide emulsions are mixed to be used for the purpose of obtaining a wider exposure latitude. In the present invention, even where, as each monodispersed emulsion, appropriately sensitized emulsions as defined above are mixed to be used, the same effect as of the present invention may be obtained. Accordingly, in the present invention, not less than two different mean particle sizes-having monodispersed emulsions may be mixed to be used.

The silver halide particle to be used in the present invention may be in such an irregular crystal form as plate crystal, the so-called twin, or may also be in such a regular crystal form as cubic, octahedral, tetradecahedral, spherical or the like crystal. The silver halide particle may be of the so-called core-shell type consisting of the core and shell portions. In this case, the photographic characteristics of the core and shell portions and the silver halide composition may be either equal or different, and the core portion may or may not contain iodide.

The silver halide for use in the color photographic light-sensitive material of the present invention is composed substantially of silver iodobromide, and the silver iodobromide in this invention is desirable to contain not less than 0.1 mole% silver iodide.

In the silver halide color photographic light-sensitive material of the present invention, at least one layer of at least one silver halide emulsion layer having a sensitivity to a certain spectral region satisfies the above-described conditions. In such a silver halide color photographic light-sensitive material, for example, in the case of applying the conditions to an ordinary multicolor photographic light-sensitive material having a blue-sensitive emulsion layer, a green-sensitive emulsion layer and a red-sensitive emulsion layer, one or more of these layers should satisfy the above conditions, and, particularly, because the human eye is most sensitive to green light among visible rays, at least the green-sensitive emulsion layer is desirable to satisfy the above conditions.

In the present invention, particularly when the foregoing conditions are applied to a color photographic light-sensitive material comprising a negative-type silver halide emulsion, a favorable effect can be obtained, the negative-type silver halide emulsion being a surface latent image-type emulsion having a sensitivity speck principally on the surface of the silver halide particle thereof, which emulsion, when exposed to light and then developed in a surface developer solution, produces on the surface thereof a blackened silver image whose black densities have inversely proportional relations with the light and darkness of the object.

The silver halide particles for use in the silver halide color photographic light-sensitive material of the present invention may be prepared by any of the acid method, neutral method and ammoniacal method, and may also be prepared in such a manner, for example, that seed particles are first prepared by the acid method, which are then grown into a desired particle size by the ammoniacal method that causes the particles to grow fast. When growing the silver halide particles, it is desirable to control the pH, pAg, etc., inside the reactor and to slowly inject and simultaneously mix into the reaction system silver and halide ions in quantities suitable for the growing speed of the silver halide particles as described in Japanese Patent Publication Open to Public Inspection (hereinafter referred to as Japanese Patent O.P.I. Publication) No. 48521/1979.

The silver halide may be chemically sensitized by the single use or arbitrarily combined use (e.g., combined use of a gold sensitizer with a sulfur sensitizer, a gold sensitizer with a selenium sensitizer, etc.) of active gelatin; sulfur sensitizers such as, e.g., arylthiocarbamide, thiourea, cystine and the like; selenium sensitizers; reduction sensitizers such as, e.g., stannous salts, thiourea dioxide, polyamines, and the like; noble-metallic sensitizers including gold sensitizers such as, e.g., potassium aurithiocyanate, potassium chloroaurate, 2-aurosulfobenzothiazole methochloride, and the like, and water-soluble salt sensitizers of palladium, platinum, ruthenium, rhodium, iridium, and the like, such as ammonium chloropalladate, potassium chloroplatinate, sodium chloropalladite, and the like (some of these compounds function as either sensitizer or fog restrainer according to the quantity used).

Further, the silver halide may be optically sensitized to any desired wavelength regions by the single use or combined use of cyanine dyes such as, e.g., zeromethine dyes, monomethine dyes, dimethine dyes, trimethine dyes, etc., or merocyanine dyes, and the like.

For the color photographic light-sensitive material of the present invention, compounds which react with the oxide of the foregoing developing agent during the development reaction to form dyes; i.e., couplers, are used. The couplers should be present during the color development; they may be present either in the developer solution or in the color light-sensitive material. If, however, these couplers are nondiffusible, they are desirable to be present in the color light-sensitive material, and generally they are incorporated into the silver halide emulsion layers of the light-sensitive material.

With this incorporation, if necessary, other additives such as a hydroquinone derivative, ultraviolet absorbing agent, anti-discoloration agent, and the like, may be used in combination with the couplers. In addition, not less than two couplers may be used in the form of a mixture.

Those couplers usable for the color photographic light-sensitive material of the present invention include all the conventionally known photographic couplers such as four- and two-equivalent coupler, but those preferred couplers include $\alpha$-acylacetamide-type yellow couplers ($\alpha$-benzoylacetanilide-type yellow couplers, $\alpha$-pivaloylacetanilide-type yellow couplers, etc.), 5-pyrazolone-type magenta couplers, pyrazolinobenzimidazole-type magenta couplers, phenol-type cyan couplers, and naphthol-type cyan couplers.

Preferred examples of the above-mentioned yellow couplers, magenta couplers and cyan couplers are those compounds as described in Japanese Patent Application Nos. 200552/1981 and 200611/1981, and these compounds can be arbitrarily used.

It is desirable to incorporate into at least one light-sensitive layer of the color photographic light-sensitive material of the present invention a compound which reacts with the oxidized product of a color developing agent to release a development inhibitor. Generally, the incorporation of such a compound improves remarkably the sharpness, graininess, color purity and exposure latitude as compared to those of conventional color photographic light-sensitive materials.

As the compound that releases a development inhibitor by the reaction thereof with the oxidized product of a color developing agent, there are known those compounds which couple with the oxidized product of a color developing agent to produce a dye and release a development inhibitor (hereinafter referred to as DIR couplers) as described in, e.g., U.S. Pat. Nos. 3,148,062 and 3,227,554, and those compounds which, by coupling with the oxidized product of a color developing agent, release a development inhibitor but not form any dye (hereinafter referred to as DIR materials) as described in U.S. Pat. No. 3,632,345 (DIR couplers and DIR materials are hereinafter called generically DIR compounds).

Preferred examples of such DIR compounds are those compounds as described in, e.g., the foregoing Japanese Patent Application No. 200611/1981, and these compounds may be arbitrarily used.

To other details of the composition of the silver halide color photographic light-sensitive material of the present invention may be applied those described in Research Disclosure Vol.176, No.17463 (December 1978) and No.18431.

The silver halide color photographic light-sensitive material of the present invention is a high-speed light-sensitive material for photographing use, the color formed from which may or may not have the equal or complementary color relations with the color of the light used in exposure, and it is usable for color negative film, color reversal film, color 8 mm movie film, standard color movie film, and the like.

The color photographic light-sensitive material of the present invention can, after being exposed imagewise to light, be developed by a normally used color developing method to thereby form a color image.

Color developing agents for processing the color photographic light-sensitive material of the invention are alkaline aqueous solutions of pH 8 or higher including the developing agent and, more preferably, those of from pH 9 to pH 12. Aromatic primary amino developing agent to serve as the abovementioned developing agent means a compound having a primary amino group on the aromatic ring and capable of developing a silver halide having been exposed to light, or a precursor capable of forming such a compound as mentioned above.

The abovementioned developing agents may be typified by those of a p-phenylenediamine, and the following may be given as the preferable examples:

4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$- methoxyethylaniline, 3-β-methanesulfonamidoethyl-4-amino-N,N-diethylaniline, 3-methoxy-4-amino-N-ethyl-N-β-hydroxyethylaniline, 3-methoxy-4-amino-N-ethyl-β-methoxyethylaniline, 3-acetamide-4-amino-N,N-diethylaniline, 4-amino-N,N-dimethylaniline, N-ethyl-N-β-[β-(β-methoxyethoxy)ethoxy]ethyl-3-methyl-4-aminoaniline, N-ethyl-N-β-[β-methoxyethoxy]ethyl-3-methyl-4-aminoaniline and the salts thereof such as those of a sulfate, chloride, sulfite, p-toluene sulfonate or the like.

If necessary, a variety of the additives such as an alkalizer, pH adjuster, buffer, development accelerator, antifoggant, preservative and the like may be added to these color developers.

There are no particular restrictions on the processing of the color photographic light-sensitive material of the present invention; any processing methods can be used typical ones of which are as described in the aforementioned Japanese Patent Application No. 200611/1981 and they may be arbitrarily used.

Examples of the present invention will be illustrated below, but the present invention is not limited thereto.

Firstly, the method for the preparation of the emulsion used in the following examples is given below:

Preparation of a polydispersed emulsion:

An aqueous silver nitrate solution, an aqueous potassium bromide solution and an aqueous potassium iodide solution were spontaneously dropped into a reactor in advance containing an aqueous gelatin solution and a supplementary halide being kept at a temperature of 60° C. To the mixture were then added an aqueous Demol N solution (produced by Kawo Atlas) and an aqueous magnesium sulfate solution to produce a precipitate for desalting, and gelatin was added thereto to thereby prepare an emulsion of pAg 7.8 and pH 6.0. The emulsion was then chemically ripened using sodium thiosulfate, chloroauric acid and ammonium thiocyanate, and after that 4-hydroxy-6-methyl-1,3,3a,7-tetrazaindene, and 6-nitrobenzimidazole, and then gelatin was added to the emulsion, thereby producing a polydispersed silver iodobromide emulsion, wherein the alkaline halide composition was changed to thereby change the molar percentage of the silver iodide, and the adding periods of both of the aqueous silver nitrate solution and the aqueous alkaline halide solution were changed to thereby change the mean particle size and the particle size distribution.

Preparation of a monodispersed emulsion:

To an aqueous potassium iodide and gelatin solution-in-advance-containing reactor, with controlling the pAg and pH thereinside, were added an aqueous ammoniacal silver nitrate solution and an aqueous potassium bromide solution in proportion to the increase in the surface area of the particles during the growth thereof. After that an aqueous Demol N solution (produced by Kawo Atlas) and an aqueous magnesium sulfate solution were added to the mixture to produce a precipitate for desalting, and then gelatin was added thereto, thereby producing an emulsion of pAg 7.8 and pH 6.0. The emulsion was chemically ripened adding sodium thiosulfate, chloroauric acid and ammonium thiocyanate thereto, and after that 4-hydroxy-6-methyl-1,3,3a,7-tetrazaindene and 6-nitrobenzimidazole, and further gelatin were added thereto, thereby obtaining a monodispersed silver iodobromide emulsion, wherein the proportion of the potassium iodide to the potassium bromide were changed to thereby change the molar percentage of the silver iodide, and the adding quantities of the ammoniacal silver nitrate and the potassium halide were changed to thereby change the particle size.

By the above-described treatments 12 kinds of silver halide emulsion were obtained as given in Table 1.

TABLE 1

| Emulsion | EM-1 | EM-2 | EM-3 | EM-4 | EM-5 | EM-6 |
|---|---|---|---|---|---|---|
| Silver iodide (mole %) | 6.0 | 6.0 | 6.0 | 6.0 | 6.0 | 6.0 |
| Mean particle size $\bar{r}$ (μ) | 0.38 | 0.41 | 0.58 | 0.75 | 0.80 | 0.38 |
| Standard deviation S | 0.125 | 0.139 | 0.168 | 0.218 | 0.208 | 0.046 |
| Monodispersing degree $S/\bar{r}$ | 0.33 | 0.34 | 0.29 | 0.29 | 0.26 | 0.12 |
| **Emulsion** | **EM-7** | **EM-8** | **EM-9** | **EM-10** | **EM-11** | **EM-12** |
| Silver iodide (mole %) | 6.0 | 6.0 | 6.0 | 6.0 | 6.0 | 6.0 |
| Mean particle size $\bar{r}$ (μ) | 0.41 | 0.48 | 0.58 | 0.67 | 0.75 | 0.80 |
| Standard deviation S | 0.041 | 0.062 | 0.058 | 0.060 | 0.060 | 0.072 |
| Monodispersing degree $S/\bar{r}$ | 0.10 | 0.13 | 0.10 | 0.09 | 0.08 | 0.09 |

EXAMPLE 1

A subbing layer-coated transparent cellulose triacetate film support was coated thereover with the following layers in the described order, thereby preparing sample-1 (in all the following examples, the adding quantities of additives to the silver halide color photographic light-sensitive material are given as those per $m^2$, and the quantities of the silver halide emulsion and colloidal silver are given in silver equivalent.).

Sample-1

Layer 1: An antihalation layer containing 0.4 g of black colloidal silver and 3 g of gelatin.

Layer 2: A low-speed red-sensitive emulsion layer comprising 1.5 g of a low-speed red-sensitive silver iodobromide emulsion (the emulsion prepared by sensitizing the emulsion EM-1 given in Table 1 to be red-sensitive), 1.6 g of gelatin, and 0.4 g of tricresyl phosphate (hereinafter referred to as TCP) into which are dissolved 0.80 g of 1-hydroxy-4-(β-methoxyethylaminocarbonylmethoxy)-N-[δ-(2,4-di-t-amylphenoxy)butyl]-2-naphthoamide (hereinafter referred to as cyan coupler C-1) and 0.028 g of 1-hydroxy-4-[4-(1-hydroxy-8-acetamido-3,6-disulfo-2-naphthylazo)-phenoxy]-N-[δ-(2,4-di-t-amylphenoxy)butyl]-2-naphthoamide disodium salt (hereinafter referred to as colored cyan coupler CC-1).

Layer 3: A high-speed red-sensitive emulsion layer comprising 1.1 g of a high-speed red-sensitive silver iodobromide emulsion (the emulsion prepared by sensitizing the emulsion EM-4 given in Table 1 to be red-sensitive), 1.2 g of gelatin, and 0.15 g of TCP into which are dissolved 0.23 g of cyan coupler C-1 and 0.20 g of colored cyan coupler CC-1.

Layer 4: An interlayer containing 0.04 g of di-n-butyl-phthalate (hereinafter referred to as DBP) into which is dissolved 0.07 g of 2,5-di-t-octyl-hydroquinone (hereinafter referred to as anti-stain agent HQ-1), and 1.2 g of gelatin.

Layer 5: A low-speed green-sensitive emulsion layer containing 1.6 g of a low-speed green-sensitive silver iodobromide emulsion (the emulsion prepared by sensitizing the emulsion EM-1 to be green-sensitive), 1.7 g of gelatin, and 0.3 g of TCP into which are dissolved three couplers: 0.30 g of 1-(2,4,6-trichlorophenyl)-3-[3-(2,4-di-t-amylphenoxyacetamido)benzamido]-5-pyrazolone (hereinafter referred to as magenta coupler M-1), 0.20 g of 4,4-methylene-bis-1-(2,4,6-trichlorophenyl)-3-[3-(2,4-di-t-amylphenoxyacetamido)benzamido]-5-pyrazolone (hereinafter referred to as magenta coupler M-2) and 0.066 g of 1-(2,4,6-trichlorophenyl)-4-(1-naphthylazo)-3-(2-chloro-5-octadecenylsuccinimidoanilino)-5-pyrazolone (hereinafter referred to as colored magenta coupler CM-1).

Layer 6: A high-speed green-sensitive emulsion layer containing 1.5 g of a high-speed green-sensitive silver iodobromide emulsion (the emulsion prepared by sensitizing the emulsion EM-4 to be green-sensitive), 1.9 g of gelatin, and 0.12 g of TCP into which are dissolved three couplers: 0.093 g of magenta coupler M-1, 0.094 g of magenta coupler M-2 and 0.049 g of colored magenta coupler CM-1.

Layer 7: An yellow filter layer containing 0.2 g of yellow colloidal silver, 0.11 g of DBP into which is dissolved 0.2 g of anti-stain agent HQ-1, and 2.1 g of gelatin.

Layer 8: A low-speed blue-sensitive emulsion layer containing 0.95 g of a low-speed blue-sensitive silver iodobromide emulsion (the emulsion prepared by sensitizing the emulsion EM-1 in Table 1 to be blue-sensitive), 1.9 g of gelatin, and 0.93 g of DBP into which are dissolved 1.84 g of α-[4-(1-benzyl-2-phenyl-3,5-dioxo-1,2,4-triazole-4-yl)]-α-pivaloyl-2-chloro-5-[γ-2,4-di-t-amylphenoxy)butaneamido]acetanilide (hereinafter referred to as yellow coupler Y-1).

Layer 9: A high-speed blue-sensitive emulsion layer containing 1.2 g of a high-speed blue-sensitive silver iodobromide emulsion (the emulsion prepared by sensitizing the emulsion EM-4 in Table 1 to be blue-sensitive), 2.0 g of gelatin, and 0.23 g of DBP into which is dissolved 0.46 g of yellow coupler Y-1.

Layer 10: A protection layer containing 2.3 g of gelatin.

Some others of the emulsions given in Table 1 were appropriately spectrally sensitized to be green-sensitive to be used in combination with the above green-sensitive layers to prepare samples-2 to -8 in the same manner as in sample-1. Details of the samples are as given in Table 2. In addtion, a DIR compound was appropriately used according to each emulsion for the adjustment of the gradation thereof.

TABLE 2

| | 5th layer (low-speed green-sensitive layer) | | 6th layer (high-speed green-sensitive layer) | | | |
|---|---|---|---|---|---|---|
| | Emulsion No. | Mixing ratio by wt. | Emulsion No. | Mixing ratio by wt. | Δ log E ($S_2$-$S_1$) | 2 log ($x_2$/$x_1$) |
| Sample-1 (control) | EM-1 | — | EM-4 | — | 0.50 | — |
| Sample-2 (control) | EM-1/ EM-7 | 2/1 | EM-4 | — | 0.49 | — |
| Sample-3 (control) | EM-1 | — | EM-4/ EM-12 | 2/1 | 0.50 | — |
| Sample-4 (control) | EM-1/ EM-11 | 2/1 | EM-4/ EM-12 | 2/1 | 0.20 | 0.05 |

TABLE 2-continued

| | 5th layer (low-speed green-sensitive layer) | | 6th layer (high-speed green-sensitive layer) | | | |
|---|---|---|---|---|---|---|
| | Emulsion No. | Mixing ratio by wt. | Emulsion No. | Mixing ratio by wt. | Δ log E ($S_2$-$S_1$) | 2 log ($x_2$/$x_1$) |
| Sample-5 (invention) | EM-1/ EM-7 | 2/1 | EM-4/ EM-12 | 2/1 | 0.55 | 0.58 |
| Sample-6 (invention) | EM-1/ EM-8 | 2/1 | EM-4/ EM-12 | 2/1 | 0.52 | 0.44 |
| Sample-7 (invention) | EM-1/ EM-9 | 2/1 | EM-4/ EM-12 | 2/1 | 0.46 | 0.28 |
| Sample-8 (control) | EM-1/ EM-10 | 2/1 | EM-4/ EM-12 | 2/1 | 0.35 | 0.15 |

Note: Δ log E represents the difference ($S_2$-$S_1$) between the speed of the high-speed green-sensitive layer ($S_2$: density = fog + 0.1) and the speed of the low-speed green-sensitive layer ($S_1$: density = fog + 0.1)

Each of the thus obtained eight samples was exposed so that the maximum density is obtained (with such an exposure as to give the maximum density when the sample is exposed through an optical wedge to a given white light and then processed in the following steps) and then processed in the following processing steps to thereby obtain a dye image.

| Processing steps (Processing temperature: 38° C.) | Processing time |
|---|---|
| Color developing | 3 min. 15 sec. |
| Bleach-fixing | 6 min. 30 sec. |
| Washing | 3 min. 15 sec. |
| Fixing | 6 min. 30 sec. |
| Washing | 3 min. 15 sec. |
| Stabilizing | 1 min. 30 sec. |
| Drying | |

The compositions of the processing liquids used in the respective processing steps are as follows:

| | |
|---|---|
| **Color developer:** | |
| 4-amino-3-methyl-N—ethyl-N—(β-hydroxyethyl)-aniline sulfate | 4.75 g |
| Anhydrous sodium sulfite | 4.25 g |
| Hydroxylamine ½ sulfate | 2.0 |
| Anhydrous potassium carbonate | 37.5 g |
| Sodium bromide | 1.3 g |
| Trisodium nitrilotriacetate, monohydrated | 2.5 g |
| Potassium hydroxide | 1.0 g |
| Water to make 1 liter | |
| **Bleach-fixer:** | |
| Iron-ammonium ethylenediaminetetraacetate | 100.0 g |
| Diammonium ethylenediamine tetraacetate | 10.0 g |
| Ammonium bromide | 150.0 g |
| Glacial acetic acid | 10.0 ml |
| Water to make 1 liter | |
| Use aqueous ammonia to adjust the pH to 6.0. | |
| **Fixer:** | |
| Ammonium thiosulfate | 175.0 g |
| Anhydrous sodium sulfite | 8.6 g |
| Sodium metasulfite | 2.3 g |
| Water to make 1 liter | |
| Use acetic acid to adjust the pH to 6.0. | |
| **Stabilizer:** | |
| Formalin (37% aqueous solution) | 1.5 ml |
| Koniducks (produced by Konishiroku Photo Industry Co., Ltd.) | 7.5 ml |
| Water to make 1 liter | |

Each of the thus processed samples was measured for the relative speed and relative granularities thereof. The obtained results are as shown in Table 3.

In addition, the relative speeds shown in Table 3 are the relative values of the respective samples when the speed (density=fog+0.1) of sample-1 is regarded as 100, and the relative improvements in granularities ($RD_1$, $RD_2$, and $RD_3$) are the relative values of the respective samples when the 1000-fold values of the standard deviations of the variations of the density values obtained at the time of scanning the densities of fog+0.3, +0.6 and +0.9 by means of a microdensitometer having a 25μ circular scanning head are regarded 100, respectively.

TABLE 3

| | Relative speed | Relative improvements in granularity* | | |
|---|---|---|---|---|
| | | $RD_1$ | $RD_2$ | $RD_3$ |
| Sample-1 (control) | 100 | 100 | 100 | 100 |
| Sample-2 (control) | 100 | 100 | 100 | 110 |
| Sample-3 (control) | 110 | 110 | 100 | 100 |
| Sample-4 (control) | 110 | 110 | 90 | 70 |
| Sample-5 (invention) | 110 | 110 | 115 | 135 |
| Sample-6 (invention) | 110 | 110 | 125 | 130 |
| Sample-7 (invention) | 110 | 110 | 130 | 130 |
| Sample-8 (control) | 110 | 115 | 95 | 80 |

*based on (control) Sample 1

As apparent from Table 3, it is recognized that samples-5, -6 and -7 in accordance with the present invention are relatively higher in the speed and better improved in the granularities in the respective densities than the control samples. The speed and the granularity have been conventionally deemed to have reciprocal relations with each other, but the present invention is an epochal invention that enables the concurrent realization of both the high speed and the high granularity of light-sensitive materials.

EXAMPLE 2

A subbing layer-coated transparent polyethylene terephthalate film support was coated thereover with the following layers in the described order to therby prepare sample-9.

Sample-9

Layer-1: prepared and coated in the same manner as in the layer-1 of sample-1.

Layer-2: prepared and coated in the same manner as in the layer-2 of sample 1.

Layer-3: prepared and coated in the same manner as in the layer-3 of sample-1.

Layer-4: prepared and coated in the same manner as in the layer-4 of sample-1.

Layer-5: prepared and coated in the same manner as in the layer-5 of sample-7.

Layer-6: prepared and coated in the same manner as in the layer-6 of sample-7.

Layer-7: prepared and coated in the same manner as in the layer-7 of sample-7.

Layer-8: prepared and coated in the same manner as in the layer-8 of sample-7 except that EM-2 was used in place of the emulsion EM-1 used in sample-7.

Layer-9: prepared and coated in the same manner as in the layer-9 of sample-7 except that EM-5 was used in place of the emulsion EM-4 used in sample-7.

Layer-10: prepared and coated in the same manner as in layer-10 of sample-1.

Further, emulsions obtained by sensitizing some of the emulsions given in Table 1 to be optimally blue-sensitive were used as the blue-sensitive silver iodobromide emulsion layers to prepare samples-10, -11, -12, -13, -14, -15 and -16 in the same manner as in the above-described sample-9. Details of these samples are shown in Table 4.

In addition, a DIR compound was appropriately used according to each emulsion for the adjustment of the gradation thereof.

And each sample was exposed to light and then processed in the same manner as in Example 1, and the relative speed and granularity improvements thereof were evaluated. The results obtained are as shown in Table 5.

TABLE 4

| | 8th layer (low-speed blue-sensitive layer) | | 9th layer (high-speed blue-sensitive layer) | | | |
|---|---|---|---|---|---|---|
| | Emulsion | Mixing ratio by wt. | Emulsion | Mixing ratio by wt. | Δ log E ($S_2$-$S_1$) | 2 log ($x_2/x_1$) |
| Sample-9 (control) | EM-2 | Single | EM-5 | Single | 0.60 | 0.59 |
| Sample-10 (control) | EM-2 | Single | EM-5/EM-12 | ½ | 0.65 | 0.62 |
| Sample-11 (control) | EM-2 | Single | EM-5/EM-11 | ½ | 0.58 | 0.60 |
| Sample-12 (control) | EM-2/EM-7 | 2/1 | EM-5 | Single | 0.62 | 0.58 |
| Sample-13 (invention) | EM-2/EM-7 | ½ | EM-5/EM-12 | ½ | 0.63 | 0.58 |
| Sample-14 (invention) | EM-2/EM-8 | 1/1 | EM-5/EM-12 | ½ | 0.53 | 0.44 |
| Sample-15 (invention) | EM-2/EM-9 | 2/1 | EM-5/EM-12 | ½ | 0.49 | 0.28 |
| Sample-16 (control) | EM-2/EM-6 | 2/1 | EM-5/EM-12 | ½ | 0.70 | 0.65 |

TABLE 5

| | Relative speed | Relative improvements in granularity* | | |
|---|---|---|---|---|
| | | $RD_1$ | $RD_2$ | $RD_3$ |
| Sample-9 (control) | 100 | 100 | 100 | 100 |
| Sample-10 (control) | 110 | 110 | 102 | 100 |
| Sample-11 (control) | 98 | 115 | 104 | 100 |
| Sample-12 (control) | 100 | 100 | 90 | 120 |
| Sample-13 (invention) | 110 | 110 | 108 | 130 |
| Sample-14 (invention) | 110 | 112 | 110 | 126 |
| Sample-15 (invention) | 110 | 116 | 120 | 123 |
| Sample-16 (control) | 110 | 110 | 100 | 126 |

*based on (control) Sample 9

As apparent from Table 5, it is recognized that the samples of the present invention not only have high speeds but are improved on the granularity in each density as compared to those of the comparative samples. Sample-16, although the speed and granularity thereof are improved up to almost the same level as those of the samples of this invention, is not sufficiently improved on the granularity in the halftone area, and the gradation thereof is inconsistent. In sample-11, the granularity in the low-density area is improved, but that in the high-density area is not sufficiently improved, and the speed is somewhat reduced, and thus the sample cannot be deemed to have satisfactory characteristics.

EXAMPLE 3

A subbing layer-coated transparent polyethylene terephthalate film support was coated thereover with the following layers in the described order to thereby prepare sample-17.

Sample-17

Layer-1: prepared and coated in the same manner as in the layer-1 of sample-1.

Layer-2: prepared and coated in the same manner as in the layer-2 of sample-1 except that EM-3 was used in place of the EM-1 used in sample-1.

Layer-3: prepared and coated in the same manner as in the layer-3 of sample-1.

Layer-4: prepared and coated in the same manner as in the layer-4 of sample-1.

Layer-5: prepared and coated in the same manner as in the layer-5 of sample-7.

Layer-6: prepared and coated in the same manner as in the layer-6 of sample-7

Layer-7: prepared and coated in the same manner as in the layer-7 of sample-7.

Layer-8: prepared and coated in the same manner as in the layer-8 of sample-15.

Layer-9: prepared and coated in the same manner as in the layer-9 of sample-15.

Layer-10: prepared and coated in the same manner as in the layer-10 of sample-1.

Further, emulsions obtained by sensitizing some of the emulsions given in Table 1 to be optimally red-sensitive were used as the red-sensitive silver iodobromide emulsion layers to prepare samples-18, -19, -20, -21, -22, -23 and -24 in the same manner as in the above-described sample-17. Details of these samples are shown in Table 6.

In addition, a DIR compound was appropriately used according to each emulsion for the adjustment of the gradation thereof.

And each sample was exposed to light and then processed in the same manner as in Example 1, and the relative speed and improvements in granularity thereof were evaluated. The obtained results are as shown in Table 7.

TABLE 6

| | 2nd layer (low-speed red-sensitive layer) | | 3rd layer (high-speed red-sensitive layer) | | | |
|---|---|---|---|---|---|---|
| | Emulsion | Mixing ratio by wt. | Emulsion | Mixing ratio by wt. | Δ log E ($S_2$-$S_1$) | 2 log ($x_2/x_1$) |
| Sample-17 (control) | EM-3 | Single | EM-4 | Single | 0.4 | 0.22 |
| Sample-18 (control) | EM-3 | Single | EM-4/EM-11 | 1/1 | 0.42 | 0.22 |
| Sample-19 (control) | EM-3/EM-9 | 2/1 | EM-4 | Single | 0.43 | 0.22 |
| Sample-20 (invention) | " | " | EM-4/EM-11 | 1/1 | 0.40 | 0.22 |
| Sample-21 (invention) | " | " | EM-11 | Single | 0.42 | 0.22 |
| Sample-22 (invention) | " | 1/1 | " | " | 0.43 | 0.22 |
| Sample-23 (invention) | " | ½ | " | " | 0.46 | 0.22 |
| Sample-24 (invention) | EM-3 | Single | " | " | 0.48 | 0.22 |

TABLE 7

| | Relative speed | Relative improvements in granularity* | | |
|---|---|---|---|---|
| | | $RD_1$ | $RD_2$ | $RD_3$ |
| Sample-17 (control) | 100 | 100 | 100 | 100 |
| Sample-18 (control) | 105 | 120 | 100 | 100 |
| Sample-19 (control) | 100 | 100 | 110 | 105 |
| Sample-20 (invention) | 106 | 118 | 110 | 109 |
| Sample-21 (invention) | 110 | 125 | 112 | 110 |
| Sample-22 (invention) | 110 | 127 | 118 | 115 |
| Sample-23 (invention) | 110 | 127 | 123 | 119 |
| Sample-24 (invention) | 110 | 129 | 125 | 123 |

*based on (control) Sample 17

As apparent from Table 7, in the control samples, although a slight increase in the speed is observed, the improvement of the granularity appears only in the low-density area or only in the high-density area, and thus no overall granularity's improvement is observed.

On the other hand, in the samples of the present invention, it is recognized that notwithstanding the increase in the speed, the improvement of the granularity through the low-density area into the high-density area is accomplished, and further as the proportion of the monodispersed emulsion standing in the total emulsion increases, the effect of it becomes more conspicuous. If the monodispersed emulsion is merely applied to the highest-speed emulsion layer alone or to the high-speed emulsion layer alone, the present invention would be unable to display its effect. The effect of this invention will not be accomplished unless the monodispersed emulsion is applied to both above emulsions, and unless the relations specified in this invention between the speed and the particle size of the monodispersed emulsion are satisfied.

The use of the construction that has been illustrated above enables the realization of such effects that even the inventor of the present invention had not expected.

What we claim is:

1. A silver halide color photographic light-sensitive material comprising a support having at least one silver halide emulsion layer thereon which has a sensitivity to a certain spectral region, at least one of said silver halide emulsion layers comprising a plurality of different speed light-sensitive layers, wherein the difference in the speed between the fastest-speed layer and the second fastest-speed layer of said plurality of light-sensitive layers is from 0.2 to 0.7 in terms of log I t, and at least said first fastest-speed and second fastest-speed layers each contains at least one monodispersed silver halide emulsion which is light-sensitive and consists substantially of a monodispersed silver halide having a granularity distribution $$S/\bar{r} \leqq 0.15,\ S = \sqrt{\Sigma(\bar{r} - ri)^2 ni / \Sigma ni} \text{ and } \bar{r} = \frac{\Sigma rini}{\Sigma ni}$$

wherein S is the standard deviation of particle size, r is the average particle size, and ri and ni are the particle size of the ith particle and the number of particles having size ri respectively.

2. The silver halide color photographic light-sensitive material as defined in claim 1 wherein $$S/\bar{r} \leqq 0.10$$

wherein S and r are defined in claim 1.

3. The silver halide color photographic light-sensitive material as defined in claim 1, wherein each of the silver halide particles contained in said plurality of different speed light-sensitive layers satisfies the relation represented by the formula:

$$0.20 < 2 \log (x_2/x_1) < 0.60$$

wherein $x_1$, in the silver halide particles contained in the highest-speed layer, represents the largest particle size of the particle sizes giving the maximum value of the granurality distribution, and $x_2$, in the silver halide particles contained in the second highest-speed layer, represents the largest particle size of the particle sizes giving the maximum value of the granularity distribution.

4. The silver halide color photographic light-sensitive material as defined in claim 3, wherein the group of said largest particle size having silver halide particles of said particle sizes giving the maximum value of said granularity distribution in each of said highest-speed and second highest-speed layers consists substantially of monodispersed silver halide particles.

5. The silver halide color photographic light-sensitive material of claim 1 wherein the silver halide emulsion in at least one light-sensitive layer of said plurality of light-sensitive layers comprises substantially regular crystals.

6. The silver halide color photographic light-sensitive material as defined in claim 1, wherein the amount of said monodispersed silver halide emulsion contained in said highest-speed layer and said second highest-speed layer accounts for not less than 30% by weight of the total silver halide emulsions.

7. The silver halide color photographic light-sensitive material as defined in claim 1, wherein said at least one silver halide emulsion layer having a sensitivity to a certain spectral region comprises a yellow coupler containing blue-sensitive silver halide emulsion layer, a magenta coupler-containing green-sensitive silver halide emulsion layer, and a cyan coupler-containing red-sensitive silver halide emulsion layer.

8. The silver halide color photographic light-sensitive material of claim 1 wherein said silver halide emulsion layers are negative-type silver halide emulsion layers.

9. The silver halide color photographic light-sensitive material as defined in claim 6, wherein the amount of said monodispersed silver halide emulsion contained in said highest-speed layer and said second highest-speed layer accounts for not less than 50% by weight of the total silver halide emulsions.

10. The silver halide color photographic light-sensitive material as defined in claim 1, wherein among a plurality of different-speed light-sensitive layers, the upper layer from the support is a light-sensitive layer containing silver halide particles whose sensitivity are higher than those of the lower layer.

11. The silver halide color photographic light-sensitive material as defined in claim 10 wherein the mean particle size of the silver halide particles contained in the higher-speed emulsion layer is from 0.4 to 15μ, while the mean particle size of the silver hallide particles contained in the lower-speed emulsion layer is from 0.1 to 0.8μ.

12. The silver halide color photographic light-sensitive material as defined in claim 1, wherein the silver halide each respectively contained in a plurality of said light-sensitive layers having respectively different speeds, are silver iodobromide each containing not less than 0.1 mole % silver iodide.

13. The silver halide color photographic light-sensitive material as defined in claim 7, wherein, in a plurality of the light-sensitive layers comprising magenta coupler containing green-sensitive silver halide emulsion layer, the difference in the speed between said highest-speed layer and said second highest-speed layer is from 0.2 to 0.7 in the term of log I·t.

14. The silver halide color photographic light-sensitive material as defined in claim 1, wherein at least one of said light-sensitive layers contains a compound which reacts with an oxidized product of a color developing agent to release a development inhibitor.

15. The silver halide color photographic light-sensitive material as defined in claim 5, wherein said silver halide emulsion layers are negative-type silver halide emulsion layers.

16. The silver halide color photographic light-sensitive material of claim 2 wherein the silver halide emulsion in at least one light-sensitive layer of said plurality of light-sensitive layers comprises substantially regular crystals.

17. The silver halide color photographic light-sensitive material of claim 3 wherein the silver halide emulsion in at least one light-sensitive layer of said plurality of light-sensitive layers comprises substantially regular crystals.

18. The silver halide color photographic light-sensitive material of claim 4 wherein the silver halide emulsion in at least one light-sensitive layer of said plurality of light-sensitive layers comprises substantially regular crystals.

19. The silver halide color photographic light-sensitive material of claim 2 wherein said silver halide emulsion layers are negative-type silver halide emulsion layers.

20. The silver halide color photographic light-sensitive material of claim 3 wherein said silver halide emulsion layers are negative-type silver halide emulsion layers.

21. The silver halide color photographic light-sensitive material of claim 4 wherein said silver halide emulsion layers are negative-type silver halide emulsion layers.

22. The silver halide color photographic light-sensitive material of claim 6 wherein said silver halide emulsion layers are negative-type silver halide emulsion layers.

23. The silver halide color photographic light-sensitive material of claim 7 wherein said silver halide emulsion layers are negative-type silver halide emulsion layers.

24. The silver halide color photogrphic light-sensitive material of claim 16 wherein said silver halide emulsion layers are negative-type silver halide emulsion layers.

25. The silver halide color photographic light-sensitive material of claim 17 wherein said silver halide emulsion layers are negative-type silver halide emulsion layers.

26. The silver halide color photographic light-sensitive material of claim 18 wherein said silver halide emulsion layers are negative-type silver halide emulsion layers.

* * * * *